US005942476A

United States Patent [19]

Campbell

[11] Patent Number: 5,942,476

[45] Date of Patent: Aug. 24, 1999

[54] LOW-VISCOSITY HIGHLY OVERBASED PHENATE-CARBOXYLATE

[75] Inventor: Curt B. Campbell, Hercules, Calif.

[73] Assignee: Chevron Chemical Company, San Ramon, Calif.

[21] Appl. No.: 09/089,527

[22] Filed: Jun. 3, 1998

[51] Int. Cl.[6] ..... C10M 159/22

[52] U.S. Cl. ..... 508/574; 508/460; 508/586

[58] Field of Search ..... 508/460, 574, 508/586

[56] References Cited

U.S. PATENT DOCUMENTS

| | | | |
|---|---|---|---|
| 5,069,804 | 12/1991 | Marsh et al. | 508/460 |
| 5,162,085 | 11/1992 | Cane et al. | 508/586 |
| 5,433,871 | 7/1995 | O'Conner et al. | 508/460 |
| 5,437,803 | 8/1995 | Cane et al. | 508/460 |
| 5,441,652 | 8/1995 | O'Conner et al. | 508/460 |
| 5,714,443 | 2/1998 | Cane et al. | 508/460 |
| 5,716,914 | 2/1998 | Cane et al. | 508/574 |
| 5,728,657 | 3/1998 | Campbell et al. | 508/574 |

FOREIGN PATENT DOCUMENTS

| | | | |
|---|---|---|---|
| 0 094814 | 11/1983 | European Pat. Off. | C10M 129/40 |
| 88/03944 | 6/1988 | WIPO | C10M 159/22 |
| 88/03945 | 6/1988 | WIPO | C10M 159/22 |

*Primary Examiner*—Jerry D. Johnson
*Attorney, Agent, or Firm*—Ernest A. Schaal

[57] ABSTRACT

A low-viscosity overbased hydrocarbyl phenate-carboxylate is produced by contacting a mixture of a hydrocarbyl phenate, at least one solvent, metal hydroxide, aqueous metal chloride, and an alkyl polyhydric alcohol containing from one to five carbon atoms with carbon dioxide under overbasing reaction conditions. The hydrocarbyl phenate is treated with a long-chain carboxylic acid, anhydride or salt thereof to form the hydrocarbyl phenate-carboxylate before, during, or subsequent to overbasing. The hydrocarbyl phenate can be sulfurized or unsulfurized.

13 Claims, No Drawings

LOW-VISCOSITY HIGHLY OVERBASED PHENATE-CARBOXYLATE

BACKGROUND OF THE INVENTION

The present invention comes out of work in the production of phenate-stearates having a high Total Base Number (TBN).

European Patent Application No. 0,094,814 A2 teaches improving the stability of an overbased phenate by treating the phenate with a carboxylic acid having a $C_{10}$ to $C_{24}$ unbranched segment, such as stearic acid.

PCT Patent Applications WO 88/03944 and 88/03945 teach an overbased phenate having a TBN of more than 300. This high TBN is achieved by using an additional component: either a carboxylic acid, such as stearic acid, or a di- or poly carboxylic acid having from 36 to 100 carbon atoms, or an anhydride, acid chloride, or ester thereof.

U.S. Pat. No. 5,728,657 teaches a process that produces an overbased sulfurized phenate-stearate without producing fine sediments. That process controls the degree of agitation and the ratio of ethylene glycol to water during the overbasing process to prevent the formation of fine sediments.

In the production of highly overbased phenates (TBN's in the range of 300 to 450) and even less overbased phenates (TBN's in the range of 150 to 280), the viscosity of the product is an important concern. If the viscosity is too high, it becomes difficult or impossible to handle, pump, filter, or store the product.

There have not been a large number of techniques or methods for lowering the viscosity of highly overbased phenates. However, in European Patent Application No. 0,094,814, the addition of long chain carboxylic acids during phenate processing was found to "result in valuable reduction in viscosity of oil solutions of the additive". This approach has also been disclosed in U.S. Pat. Nos. 5,069,804; 5,162,085; 5,716,914; 5,714,443; and 5,728,657.

In the preparation of what can generally be considered "fatty-acid" modified phenates, such as disclosed in the patents cited above, calcium chloride is sometimes added to the phenate process. For example, solid calcium chloride is used in U.S. Pat. Nos. 5,716,914; 5,714,443; and 5,728,657.

SUMMARY OF THE INVENTION

The present invention provides a process for producing a low-viscosity overbased hydrocarbyl phenate (sulfurized or unsulfurized) which has been treated, either before, during, or subsequent to overbasing with a long-chain carboxylic acid (preferably stearic acid), anhydride or salt thereof. That process comprises contacting a mixture of a hydrocarbyl phenate, at least one solvent, metal hydroxide, aqueous metal chloride, and an alkyl polyhydric alcohol containing from one to five carbon atoms, with carbon dioxide under overbasing reaction conditions. Using an aqueous metal chloride, instead of a solid metal chloride, reduces the viscosity of the product. Preferably, the metals are alkaline earth metals, most preferably calcium. Preferably, the alkyl polyhydric alcohol is ethylene glycol.

A minor portion of the low-viscosity overbased hydrocarbyl phenate-carboxylate prepared by this process can be used with a major portion of a base oil of lubricating viscosity to form a lubricating oil composition. That lubricating oil formulation can further comprise ashless dispersants (up to 20%), zinc dithiophosphates (up to 5%), oxidation inhibitors (up to 10%), foam inhibitors (up to 1%), and viscosity index improvers (up to 20%).

The low-viscosity overbased phenate-carboxylate prepared by this process can be used in a concentrate having 10% to 90% of a compatible organic liquid diluent and 0.5% to 90% low-viscosity overbased hydrocarbyl phenate-carboxylate.

DETAILED DESCRIPTION OF THE INVENTION

In its broadest aspect, the present invention involves a process for producing a low-viscosity phenate-carboxylate. The low-viscosity is achieved by using aqueous metal chloride, instead of a solid metal chloride.

Prior to discussing the invention in further detail, the following terms will be defined:

DEFINITIONS

As used herein the following terms have the following meanings unless expressly stated to the contrary:

The term "hydrocarbyl" means an alkyl or alkenyl group.

The term "hydrocarbyl phenol" means a phenol group having one or more hydrocarbyl substituents; at least one of which has a sufficient number of carbon atoms to impart oil solubility to the phenol.

The term "metal" means alkali metals, alkaline earth metals, or mixtures thereof.

The term "alkaline earth metal" means calcium, barium, magnesium, strontium, or mixtures thereof.

The term "phenate" means a metal salt of a phenol.

The term "hydrocarbyl phenate" means a metal salt of a hydrocarbyl phenol.

The term "long-chain carboxylic acid" means a carboxylic acid having an alkyl group having an average carbon number of from 13 to 28. The alkyl group may be linear, branched, or mixtures thereof.

The term "stearic acid" means a long-chain carboxylic acid, wherein the carbon number of the acid is predominately 18.

The term "phenate-carboxylate" means a phenate that has been treated with long-chain carboxylic acid, anhydride or salt thereof.

The term "hydrocarbyl phenate-carboxylate" means a hydrocarbyl phenate that has been treated with long-chain carboxylic acid, anhydride or salt thereof.

The term "phenate-stearate" means a phenate that has been treated with stearic acid, anhydride or salt thereof.

The term "hydrocarbyl phenate-stearate" means a hydrocarbyl phenate that has been treated with stearic acid, anhydride or salt thereof.

The term "Total Base Number" or "TBN" refers to the amount of base equivalent to milligrams of KOH in one gram of sample. Thus, higher TBN numbers reflect more alkaline products, and therefore a greater alkalinity reserve. The TBN of a sample can be determined by ASTM Test No. D2896 or any other equivalent procedure.

Unless otherwise specified, all percentages are in weight percent.

LOW-VISCOSITY OVERBASED HYDROCARBYL PHENATE-CARBOXYLATE

The low-viscosity overbased hydrocarbyl phenate-carboxylate of the present invention is produced by overbasing a hydrocarbyl phenate and treating the phenate (before, during, or after overbasing) with a long-chain carboxylic acid (preferably stearic acid), anhydride or salt thereof.

In the overbasing step, a mixture comprising hydrocarbyl phenate (which can be sulfurized or unsulfurized), at least one solvent, metal hydroxide, aqueous metal chloride, and an alkyl polyhydric alcohol containing from one to five carbon atoms is reacted with carbon dioxide under overbasing reaction conditions.

Overbasing reaction conditions include temperatures of from 250° to 375° F. at approximately atmospheric pressure.

Preferably, the overbased hydrocarbyl phenate is a sulfurized alkylphenate. Preferably, the metal is an alkaline earth metal, more preferably calcium. Preferably, the alkyl polyhydric alcohol is ethylene glycol.

The carboxylate treatment (treatment with long-chain carboxylic acid, anhydride, or salt thereof) can occur before, during, or after the overbasing step. It is unimportant when the treatment with long-chain carboxylic acid, anhydride, or salt thereof occurs relative to the overbasing step. For example, the following are some of the scenarios that are possible:

Overbase the phenate, then, after the overbasing step is complete, do the carboxylate treatment of the phenate.

Overbase the phenate, and while the overbasing step is still in process, do the carboxylate treatment of the phenate. In this scenario, the carboxylate treatment can be completed before, during, or after the completion of the overbasing step.

Do the carboxylate treatment of the phenate first, then, after the carboxylate treatment step is complete, overbase the phenate.

Do the carboxylate treatment of the phenate, and while the carboxylate treatment step is still in process, overbase the phenate. In this scenario, the overbasing step can be completed before, during, or after the completion of the carboxylate treatment.

Other possible scenarios include, but are not limited to, overbasing the phenate before and after, but not during the carboxylate treatment, or doing the carboxylate treatment of the phenate before and after, but not during the overbasing step. Repeated overbasing and/or repeated carboxylate treatment is also contemplated to be within the scope of the present invention.

The phenate can be sulfurized or unsulfurized. Preferably, the phenate is sulfurized. If the phenate is sulfurized, the sulfurization step can occur anytime prior to overbasing. More preferably, the phenate is sulfurized before the overbasing step but after the carboxylate treatment.

BASE OIL OF LUBRICATING VISCOSITY

The base oil of lubricating viscosity used in such compositions may be mineral oil or synthetic oils of viscosity suitable for use in internal combustion engines. The base oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_8$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used.

Blends of mineral oils with synthetic oils are also useful. For example, blends of 10 to 25% hydrogenated 1-trimer with 75 to 90% 150 SUS (100° F.) mineral oil make excellent lubricating oil bases.

OTHER ADDITIVE COMPONENTS

The following additive components are examples of some components that can be favorably employed in conjunction with the present invention. These examples of additives are provided to illustrate the present invention, but they are not intended to limit it:

(1) Ashless dispersants: alkenyl succinimides, alkenyl succinimides modified with other organic compounds, and alkenyl succinimides modified with boric acid, alkenyl succinic ester.

(2) Oxidation inhibitors:

(a) Phenol type oxidation inhibitors: 4,4'-methylene bis (2,6-di-tert-butylphenol), 4,4'-bis(2,6-di-tert-butylphenol), 4,4'-bis(2-methyl-6-tert-butylphenol), 2,2'-methylene bis(4-methyl-6-tert-butyl-phenol), 4,4'-butylidenebis(3-methyl-6-tert-butylphenol), 4,4'-isopropyl-idenebis(2,6-di-tert-butylphenol), 2,2'-methylenebis(4-methyl-6-nonylphenol), 2,2'-isobutylidene-bis(4,6-dimethylphenol), 2,2'-methylenebis (4-methyl-6-cyclohexyl phenol), 2,6-di-tert-butyl4-methylphenol, 2,6-di-tert-butyl-4-ethylphenol, 2,4-dimethyl-6-tert-butylphenol, 2,6-di-tert4-(N,N' dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)sulfide, and bis (3,5-di-tert-butyl4-hydroxybenzyl).

(b) Diphenylamine type oxidation inhibitor: alkylated diphenylamine, phenyl-α-naphthylamine, and alkylated α-naphthylamine.

(c) Other types: metal dithiocarbamate (e.g., zinc dithiocarbamate), and methylenebis (dibutyldithiocarbamate).

(3) Rust inhibitors (Anti-rust agents)

(a) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

(b) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(4) Demulsifiers: addition product of alkylphenol and ethyleneoxide, poloxyethylene alkyl ether, and polyoxyethylene sorbitan ester.

(5) Extreme pressure agents (EP agents): zinc dialkyldithiophosphate (primary alkyl type & secondary alkyl type), sulfurized oils, diphenyl sulfide, methyl trichlorostearate, chlorinated naphthalene, fluoroalkylpolysiloxane, and lead naphthenate.

(6) Friction modifiers: fatty alcohol, fatty acid, amine, borated ester, other esters, and a host of ashless sulfur and/or phosphorus containing materials.

(7) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound.

(8) Viscosity Index Improvers: polymethacrylate type polymers, ethylene-propylene copolymers, styrene-isoprene copolymers, hydrated styrene-isoprene copolymers, polyisobutylene, and dispersant type viscosity index improvers.

(9) Pour point depressants: polymethyl methacrylate.

(10) Foam Inhibitors: alkyl methacrylate polymers and dimethyl silicone polymers.

LUBRICATING OIL COMPOSITION

The overbased hydrocarbyl phenate-carboxylates produced by the process of this invention are useful for imparting base reserve and detergency to an engine lubricating oil composition. Such a lubricating oil composition comprises a major part of a base oil of lubricating viscosity and an effective amount of hydrocarbyl phenate-carboxylate.

Adding an effective amount of hydrocarbyl phenate-carboxylate of the present invention to a lubricating oil provides base for neutralizing acids formed during combustion and/or oxidation, and improves the detergency of that lubricating oil in automotive, marine, transmission, hydraulic, and other applications.

In one embodiment, an engine lubricating oil composition would comprise (a) a major part of a base oil of lubricating viscosity;

(b) 1% to 30% of an overbased hydrocarbyl phenate-carboxylate;

(c) 0% to 20% of at least one ashless dispersant;

(d) 0% to 5% of at least one zinc dithiophosphate;

(e) 0% to 10% of at least one oxidation inhibitor;

(f) 0% to 1% of at least one foam inhibitor; and (g) 0% to 20% of at least one viscosity index improver.

In a further embodiment, an engine lubricating oil composition is produced by blending a mixture of the above components. The lubricating oil composition produced by that method might have a slightly different composition than the initial mixture, because the components may interact. The components can be blended in any order and can be blended as combinations of components.

ADDITIVE CONCENTRATES

Additive concentrates are also included within the scope of this invention. The concentrates of this invention comprise the compounds or compound mixtures of the present invention, preferably with at least one of the additives disclosed above. Typically, the concentrates contain sufficient organic diluent to make them easy to handle during shipping and storage.

From 10% to 90% of the concentrate is organic diluent. From 0.5% to 90% of concentrate is the overbased hydrocarbyl phenate-carboxylate of the present invention. The remainder of the concentrate can consist of other additives. In calculating these percentages, any organic diluent present in preparing the additive is considered organic diluent instead of phenate-carboxylate.

Suitable organic diluents which can be used include, for example, solvent refined 100N, i.e., Cit-Con 100N, and hydrotreated 100N, i.e., RLOP 100N, and the like. The organic diluent preferably has a viscosity of from about 1 to about 20 cSt at 100° 1 C.

HYDRAULIC OIL COMPOSITION

A hydraulic oil composition having improved filterability can be formed containing a major part of a base oil of lubricating viscosity, from 0.1% to 30% of the detergent-dispersant of the present invention, and preferably at least one other additive.

EXAMPLES OF ADDITIVE PACKAGES

Below are representative examples of additive packages that can be used in a variety of applications. These representative examples employ the overbased hydrocarbyl phenate-carboxylate additives of the present invention. That overbased hydrocarbyl phenate-carboxylates additive may be used either with or without other metal-containing detergents, depending upon the desired TBN of the final product. In calculating these percentages, any organic diluent present in preparing any component is considered organic diluent instead of that component. These examples are provided to illustrate the present invention, but they are not intended to limit it.

| | | |
|---|---|---|
| I. | Marine Diesel Engine Oils | |
| 1) | Overbased hydrocarbyl phenate-carboxylate | 65% |
| | Primary alkyl zinc dithiophosphate | 5% |
| | Organic diluent | 30% |
| 2) | Overbased hydrocarbyl phenate-carboxylate | 65% |
| | Alkenyl succinimide ashless dispersant | 5% |
| | Organic diluent | 30% |
| 3) | Overbased hydrocarbyl phenate-carboxylate | 60% |
| | Primary alkyl zinc dithiophosphate | 5% |
| | Alkenyl succinimide ashless dispersant | 5% |
| | Organic diluent | 30% |
| 4) | Overbased hydrocarbyl phenate-carboxylate | 65% |
| | Phenol type oxidation inhibitor | 10% |
| | Organic diluent | 25% |
| 5) | Overbased hydrocarbyl phenate-carboxylate | 55% |
| | Alkylated diphenylamine-type oxidation inhibitor | 15% |
| | Organic diluent | 30% |
| 6) | Overbased hydrocarbyl phenate-carboxylate | 65% |
| | Phenol-type oxidation inhibitor | 5% |
| | Alkylated diphenylamine-type oxidation | 5% |
| | Organic diluent | 25% |
| 7) | Overbased hydrocarbyl phenate-carboxylate | 60% |
| | Primary alkyl zinc dithiophosphate | 5% |
| | Phenol-type oxidation inhibitor | 5% |
| | Organic diluent | 30% |
| 8) | Overbased hydrocarbyl phenate-carboxylate | 60% |
| | Alkenyl succinimide ashless dispersant | 5% |
| | Alkylated diphenylamine-type oxidation inhibitor | 10% |
| | Organic diluent | 25% |
| 9) | Overbased hydrocarbyl phenate-carboxylate | 55% |
| | Other additives | 25% |
| | Primary alkyl zinc dithiophosphate | |
| | Alkenyl succinic ester ashless dispersant | |
| | Phenol-type oxidation inhibitor | |
| | Alkylated diphenylamine-type oxidation inhibitor | |
| | Organic diluent | 30% |
| II. | Motor Car Engine Oils | |
| 1) | Overbased hydrocarbyl phenate-carboxylate | 25% |
| | Alkenyl succinimide ashless dispersant | 35% |
| | Primary alkyl zinc dithiophosphate | 10% |
| | Organic diluent | 30% |
| 2) | Overbased hydrocarbyl phenate-carboxylate | 20% |
| | Alkenyl succinimide ashless dispersant | 40% |
| | Secondary alkyl zinc dithiophosphate | 5% |
| | Dithiocarbamate type oxidation inhibitor | 5% |
| | Organic diluent | 30% |
| 3) | Overbased hydrocarbyl phenate-carboxylate | 20% |
| | Alkenyl succinimide ashless dispersant | 35% |
| | Secondary alkyl zinc dithiophosphate | 5% |
| | Phenol type oxidation inhibitor | 5% |
| | Organic diluent | 35% |
| 4) | Overbased hydrocarbyl phenate-carboxylate | 20% |
| | Alkenyl succinimide ashless dispersant | 30% |
| | Secondary alkyl zinc dithiophosphate | 5% |
| | Dithiocarbamate type anti-wear agent | 5% |
| | Organic diluent | 40% |

-continued

| | | |
|---|---|---|
| 5) | Overbased hydrocarbyl phenate-carboxylate | 20% |
| | Succinimide ashless dispersant | 30% |
| | Secondary alkyl zinc dithiophosphate | 5% |
| | Molybdenum-containing anti-wear agent | 5% |
| | Organic diluent | 40% |
| 6) | Overbased hydrocarbyl phenate-carboxylate | 20% |
| | Alkenyl succinimide ashless dispersant | 30% |
| | Other additives | 10% |
| | Primary alkyl zinc dithiophosphate | |
| | Secondary alkyl zinc dithiophosphate | |
| | Alkylated diphenylamine-type oxidation inhibitor | |
| | Dithiocarbamate type anti-wear agent | |
| | Organic diluent | 40% |
| 7) | Overbased hydrocarbyl phenate-carboxylate | 60% |
| | Other additives | 10% |
| | Phenol type oxidation inhibitor | |
| | Alkylated diphenylamine-type | |
| | Oxidation inhibitor | |
| | Dithiocarbamate type anti-wear agent | |
| | Demulsifier | |
| | Boron-containing friction modifier | |
| | Organic diluent | 30% |
| III. | Hydraulic Oils | |
| 1) | Overbased hydrocarbyl phenate-carboxylate | 20% |
| | Primary alkyl zinc dithiophosphate | 50% |
| | Other additives | 25% |
| | Phenol type oxidation inhibitor | |
| | Phosphorous-containing extreme pressure agent | |
| | Triazol type corrosion inhibitor | |
| | Demulsifier | |
| | Nonionic anti-rust agent | |
| | Organic diluent | 5% |
| 2) | Overbased hydrocarbyl phenate-carboxylate | 10% |
| | Primary alkyl zinc dithiophosphate | 40% |
| | Other additives | 47% |
| | Phenol type oxidation inhibitor | |
| | Sulfur-containing extreme pressure agent | |
| | Triazol type corrosion inhibitor | |
| | Demulsifier | |
| | Nonionic anti-rust agent | |
| | Organic diluent | 3% |
| 3) | Overbased hydrocarbyl phenate-carboxylate | 10% |
| | Phosphorous-containing extreme pressure agent | 40% |
| | Phenol type oxidation inhibitor | 15% |
| | Other additives | 25% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Organic diluent | 10% |
| 4) | Overbased hydrocarbyl phenate-carboxylate | 20% |
| | Phosphorous-containing extreme pressure agent | 30% |
| | Other additives | 45% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Organic diluent | 5% |
| IV. | Transmission Hydraulic Fluids | |
| 1) | Overbased hydrocarbyl phenate-carboxylate | 35% |
| | Primary alkyl zinc dithiophosphate | 20% |
| | Polyol type friction modifier | 20% |
| | Sulfur-containing extreme pressure agent | 5% |
| | Organic diluent | 20% |
| 2) | Overbased hydrocarbyl phenate-carboxylate | 40% |
| | Primary alkyl zinc dithiophosphate | 15% |
| | Amide type friction modifier | 15% |
| | Sulfur-containing extreme pressure agent | 5% |
| | Organic diluent | 25% |
| 3) | Overbased hydrocarbyl phenate-carboxylate | 30% |
| | Primary alkyl zinc dithiophosphate | 20% |
| | Other additives | 30% |
| | Alkenyl succinimide ashless dispersant | |
| | Amide type friction modifier | |
| | Ester type friction modifier | |
| | Phosphorous, Sulfur-containing extreme pressure agent | |

-continued

| | | |
|---|---|---|
| | Organic diluent | 20% |
| 4) | Overbased hydrocarbyl phenate-carboxylate | 35% |
| | Primary alkyl zinc dithiophosphate | 15% |
| | Other additives | 25% |
| | Polyol type friction modifier | |
| | Amide type friction modifier | |
| | Phosphorous, Sulfur-containing extreme pressure agent | |
| | Organic diluent | 25% |

EXAMPLES

The invention will be further illustrated by following examples, which set forth particularly advantageous method embodiments. While the Examples are provided to illustrate the present invention, they are not intended to limit it.

Example 1

To a 1 gallon stainless steel reactor was charged:

| | |
|---|---|
| 903 grams | 100 Neutral oil, |
| 0.5 ml | antifoam, |
| 1415 grams | decyl alcohol, |
| 158 grams | ethylene glycol, |
| 642 grams | lime, |
| 1126 grams | dodecylphenol, |
| 722 grams | molten stearic acid, and |
| 34 grams | solid calcium chloride dihydrate |

at approximately room temperature (nominally 75° F.). This mixture was heated to 150° F. over approximately fifteen minutes with agitation. When the reactor reached 150° F. temperature, an additional 642 grams of lime was added to the reactor. The reactor was then sealed, placed under slight vacuum (13.7 psia) and heated to 300° F. over approximately one hour. When the reactor reached 290° F., 187 grams of molten sulfur were charged via a valved port on the reactor. When the reactor reached 300° F., 113 grams of ethylene glycol were added over 1.5 hours at approximately 1.26 grams/minute. As soon as this ethylene glycol charge was started, the temperature of the reactor was heated to 350° F. over approximately 1.5 hours. When the reactor reached 350° F., the vacuum was increased to atmospheric pressure (14.7 psia) and was held at 350° F. while 28 grams of $CO_2$ was added over thirty minutes at approximately 0.93 grams/minute. Immediately after starting this $CO_2$ addition, 180 grams of ethylene glycol was added over three hours at approximately 1.0 grams/minute. When this charge of $CO_2$ was completed, an additional 406 grams of $CO_2$ were added over three hours at approximately 2.26 grams/minute. When this $CO_2$ addition was complete 108 grams of $CO_2$ was added over two hours at approximately 0.9 grams/minute. When the $CO_2$ addition was complete, the pressure in the reactor was reduced to between 0.5 and 1.0 psia over 15 minutes and then the reactor was heated to 400° F. over thirty minutes. The reactor was held at 400° F. and 0.6 psia for thirty minutes. The pressure in the reactor was then increased to atmospheric pressure with nitrogen and the reactor allowed to cool to approximately room temperature. The contents of the reactor was drained to yield 2916 grams of crude product with a TBN of 426. This material was diluted with 100N oil and vacuum filtered with the aid of filter aid to afford a product with 400 TBN, $CO_2$ content of 10.9%, and viscosity of 496 cSt at 100° C.

Example 2

The procedure of Example 1 was followed except solid calcium dihydrate was omitted and instead, 106 grams of a 32.0% solution of calcium dihydrate in water was pumped into the reactor over approximately fifteen minutes when the reactor reached 240° F. while ramping from 150° F. to 300° F.

The crude product was diluted with 100N oil and filtered as in Example 1 to afford a product with a TBN of 400, $CO_2$ content of 10.8% and viscosity of 300 cSt at 100° C.

The above examples show that the use of aqueous metal chloride instead of solid metal chloride caused a significant reduction in product viscosity at equal TBN (300 cSt versus 496 cSt)

While the present invention has been described with reference to specific embodiments, this application is intended to cover those various changes and substitutions that may be made by those skilled in the art without departing from the spirit and scope of the appended claims.

What is claimed is:

1. A process for producing a low-viscosity overbased hydrocarbyl phenate which has been treated, before, during, or subsequent to overbasing, with a long-chain carboxylic acid, anhydride, or salt thereof to form a phenate-carboxylate, said process comprising contacting a mixture comprising a hydrocarbyl phenate, at least one solvent, metal hydroxide, aqueous metal chloride, and an alkyl polyhydric alcohol containing from one to five carbon atoms with carbon dioxide under overbasing reaction conditions.

2. A process according to claim 1 wherein the long-chain carboxylic acid is stearic acid.

3. A process according to claim 1 wherein the hydrocarbyl phenate is a sulfurized alkylphenate.

4. A process according to claim 1 wherein the metal is an alkaline earth metal.

5. A process according to claim 4 wherein the alkaline earth metal is calcium.

6. A process according to claim 1 wherein the alkyl polyhydric alcohol is ethylene glycol.

7. A low-viscosity overbased hydrocarbyl phenate-carboxylate prepared by the process according to claim 1.

8. A lubricating oil composition comprising a major portion of a base oil of lubricating viscosity and a minor portion of the low-viscosity overbased hydrocarbyl phenate-carboxylate according to claim 7.

9. A lubricating oil formulation comprising:

(a) a major amount of a base oil of lubricating viscosity;

(b) from 1 to 30% of the low-viscosity overbased hydrocarbyl phenate-carboxylate according to claim 7;

(c) from 0 to 20% of at least one ashless dispersant;

(d) from 0 to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

10. A concentrate comprising about from 10% to 90% of a compatible organic liquid diluent and about from 0.5% to 90% of the low-viscosity overbased hydrocarbyl phenate-carboxylate according to claim 7.

11. A method of producing a lubricating oil composition comprising blending the following components together:

(a) a major amount of a base oil of lubricating viscosity;

(b) from 1 to 30% of the low-viscosity overbased hydrocarbyl phenate-carboxylate according to claim 7;

(c) from 0% to 20% of at least one ashless dispersant;

(d) from 0% to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

12. A lubricating oil composition produced by the method according to claim 11.

13. A hydraulic oil composition comprising a major portion of a base oil of lubricating viscosity and from 0.1% to 30% of the low-viscosity overbased hydrocarbyl phenate-carboxylate according to claim 7.

* * * * *